US006171152B1

(12) United States Patent
Kunz

(10) Patent No.: US 6,171,152 B1
(45) **Date of Patent: *Jan. 9, 2001**

(54) STANDARD FOOTPRINT AND FORM FACTOR RJ-45 CONNECTOR WITH INTEGRATED SIGNAL CONDITIONING FOR HIGH SPEED NETWORKS

(75) Inventor: William E. Kunz, Portola Valley, CA (US)

(73) Assignee: Regal Electronics, Inc., Santa Clara, CA (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

This patent is subject to a terminal disclaimer.

(21) Appl. No.: 09/053,883

(22) Filed: Apr. 1, 1998

(51) Int. Cl.[7] ..... H01R 13/66
(52) U.S. Cl. ..... 439/620; 439/676
(58) Field of Search ..... 439/620, 676, 439/736

(56) References Cited

U.S. PATENT DOCUMENTS

| | | | | |
|---|---|---|---|---|
| 4,726,638 | * | 2/1988 | Schroeder, III | 439/620 |
| 5,037,330 | | 8/1991 | Fulponi et al. . | |
| 5,069,641 | | 12/1991 | Sakamoto et al. | 439/620 |
| 5,295,869 | | 3/1994 | Siemon et al. | 439/620 |
| 5,362,257 | | 11/1994 | Neal et al. . | |
| 5,474,474 | | 12/1995 | Siemon et al. | 439/620 |
| 5,531,612 | | 7/1996 | Goodall et al. . | |
| 5,587,884 | * | 12/1996 | Raman | 439/620 |
| 5,628,653 | | 5/1997 | Haas et al. . | |
| 5,639,267 | * | 6/1997 | Loudermilk | 439/676 |
| 5,647,765 | | 7/1997 | Haas et al. | 439/609 |
| 5,647,767 | | 7/1997 | Scheer et al. | 439/620 |
| 5,656,985 | | 8/1997 | Lu et al. | 336/96 |
| 5,687,233 | | 11/1997 | Loudermilk et al. | 379/442 |
| 5,735,712 | | 4/1998 | Haas et al. . | |
| 5,759,067 | * | 6/1998 | Scheer | 439/620 |
| 5,971,813 | | 10/1999 | Kunz et al. . | |

FOREIGN PATENT DOCUMENTS

| | | | |
|---|---|---|---|
| WO 97 10625 | * | 3/1997 | (WO) . |
| WO 97/10625 | | 3/1997 | (WO) . |

OTHER PUBLICATIONS

Stewart Connector, MagJack Modular Jacks with Integrated Magnetics, 72 Series, SCS–MJ–Nov. 1997.

* cited by examiner

*Primary Examiner*—Paula Bradley
*Assistant Examiner*—Katrina Davis
(74) *Attorney, Agent, or Firm*—Blakely, Sokoloff, Taylor & Zafman, LLP

(57) ABSTRACT

An RJ-45 style modular connector having a plastic rectangular housing with an open front end to receive a matching RJ-45 style modular jack, and an opposite open back end. A contact spring assembly of a plurality of wires in separate circuits passes forward through said open back end into the back of said open front end of the housing. The contact assembly also includes a plastic block that supports the plurality of wires by a right angle turn and is vertically oriented with respect to the plurality of wires, and the plastic block inserts and locks into the open back end of the housing. A set of mounting pins is disposed at a bottom edge of the plastic block for connection to a printed motherboard. A signal conditioning part is disposed in the plastic block for providing signal conditioning of signals passing from said set of mounting pins to the contact spring assembly. The signal conditioning part is fully disposed in the vertically oriented plastic block and directly over the set of mounting pins such that a standard form factor is not exceeded by a rear extension compartment that would otherwise be necessary, and that further provides for multilevel stacking.

12 Claims, 4 Drawing Sheets

STANDARD FOOTPRINT AND FORM FACTOR RJ-45 CONNECTOR WITH INTEGRATED SIGNAL CONDITIONING FOR HIGH SPEED NETWORKS

FIELD OF THE INVENTION

The present invention relates to electronic jacks and connectors, and more particularly to modular phone-style RJ-45 Category-3 and Category-5 network physical interface connectors.

DESCRIPTION OF THE PRIOR ART

Network interface connections have conventionally included some form of signal conditioning near the RJ-45 Category-3 or Category-5 modular connector. The usual purpose is to block spurious signals, e.g., high frequency noise, differential-mode direct current (DC), and common mode voltages. Various magnetics assemblies from HALO Electronics (Redwood City, Calif.) like the ULTRA™ series of sixteen-pin SOIC isolation modules are used to meet the requirements of IEEE Standard 802.3 for 10/100BASE-TX and ATM155 applications. A very informative background on connectors and their network applications, and a long citation of prior art, is provided by John Siemon, et al., in U.S. Pat. No. 5,474,474, issued Dec. 12, 1995. Such patent is incorporated herein by reference.

A few connector manufacturers have started to put some signal conditioning components inside the bodies of their connectors. For example, Peter Scheer, et al., describe a connector jack assembly with a rear insert that includes signal conditioning components, in U.S. Pat. No. 5,647,767, issued Jul. 15, 1997. However, the descriptions show there is a rather large housing extension necessary in the back of the connectors to accommodate a horizontally oriented printed circuit board. The footprint that results would prohibit the embodiments of Peter Scheer, et al., from being able to make a form, fit, and function substitution of ordinary connectors already designed into various network products. Venkat A. Raman also describes another connector jack with an insert body having encapsulated signal conditioning components, in U.S. Pat. No. 5,587,884, issued Dec. 24, 1996. A common mode choke and other magnetics are described as being encapsulated in the insert molding. The Raman disclosure also describes a rather large connector housing to accommodate a small horizontally oriented printed circuit board for the magnetics in the rear. So it too would not be able to directly substitute for many of the standard connections being marketed.

Gregory Loudermilk, et al., recognized the need for a filtered modular jack that provides the signal conditioning needed by high speed communications systems, and that "occupies approximately the same amount of board space on a printed circuit motherboard as do current modular jacks". But then their U.S. Pat. No. 5,687,233, issued Nov. 11, 1997, diagrams and describes a mounting pin array with a large extension to the rear to accommodate a transmit and receiver printed circuit board in a rear housing.

A very modest rearward extension to a RJ-11 modular jack is described by Yukio Sakamoto, et al., in U.S. Pat. No. 5,069,641, issued Dec. 3, 1991. A small printed circuit board is shown vertically oriented directly above the line of mounting pins and has a common mode choke coil mounted to it. Gregory Loudermilk, et al., commented that Yukio Sakamoto, et al., did not teach signal conditioning in their RJ-11 connector that was sophisticated enough for high speed applications like LAN and ATM switches.

SUMMARY OF THE INVENTION

It is therefore an object of the present invention to provide a modular connector with integrated signal conditioning in a component package that has a compatible footprint with prior art modular connectors that lack such signal conditioning.

It is a further object of the present invention to provide a modular connector system in which a single-row multi-port modular connector for printed circuit board mounting may accept a second single-row multi-port modular connector.

It is a still further object of the present invention to provide a modular connector system that will reliably survive motherboard solder operations during the assembly of other components.

Briefly, a two-row, eight-port modular connector embodiment of the present invention comprises a lower row with a four-bay insulative housing that accepts four RJ-45 style jacks from its front, and a short-height gang of four separate molded inserts from the opposite side. The four-bay insulative housing and each molded insert are essentially the same as a standalone four-port, single-row modular connector so that the single-row modular connector can be quickly and easily converted to the eight-port, two-row modular connector. Such a conversion would include an upper row four-bay insulative housing that also accepts four RJ-45 style jacks from its front and a tall gang of four molded inserts that have forward extensions of their spring contacts so they can reach from behind far enough forward over the lower first row. A three-piece Faraday shield comprises a lower middle part that covers the rear of each of the four first-row lower-row molded inserts, an aft part that covers the rear of each of the four upper-row molded inserts, and a forward part that covers the front and sides of both the four-bay insulative housings and part of the top of the housing. After assembly, the three Faraday shield pieces are electrically connected so that they constitute a continuous shield around the whole of the eight-port, two-row modular connector. Each molded insert includes a signal conditioning circuit that provides a proper electrical coupling between a physical interface device (PHY) or encoder/decoder and an unshielded twisted pair (UTP) cable to a high speed computer network. The circuit connections for the integrated signal conditioning in each insert may be welded, rather than soldered.

An advantage of the present invention is that a multi-port modular connector is provided that can be used to retrofit ordinary modular connectors because the integrated signal conditioning does not require a back extension to the main housing.

Another advantage of the present invention is that a multi-port modular connector is provided with integrated signal conditioning that will not disconnect during soldering operations of the motherboard.

These and other objects and advantages of the present invention will no doubt become obvious to those of ordinary skill in the art after having read the following detailed description of the preferred embodiments which are illustrated in the various drawing figures.

BRIEF DESCRIPTION OF DRAWINGS

FIG. 5 shows the critical maximum rear extension "B" required to maintain plug compatibility with preexisting connectors. The signal conditioning circuitry is critically placed directly above each successively deeper rows of PCB mounting pins;

DETAILED DESCRIPTION OF THE PREFERRED EMBODIMENT

Figure 1:
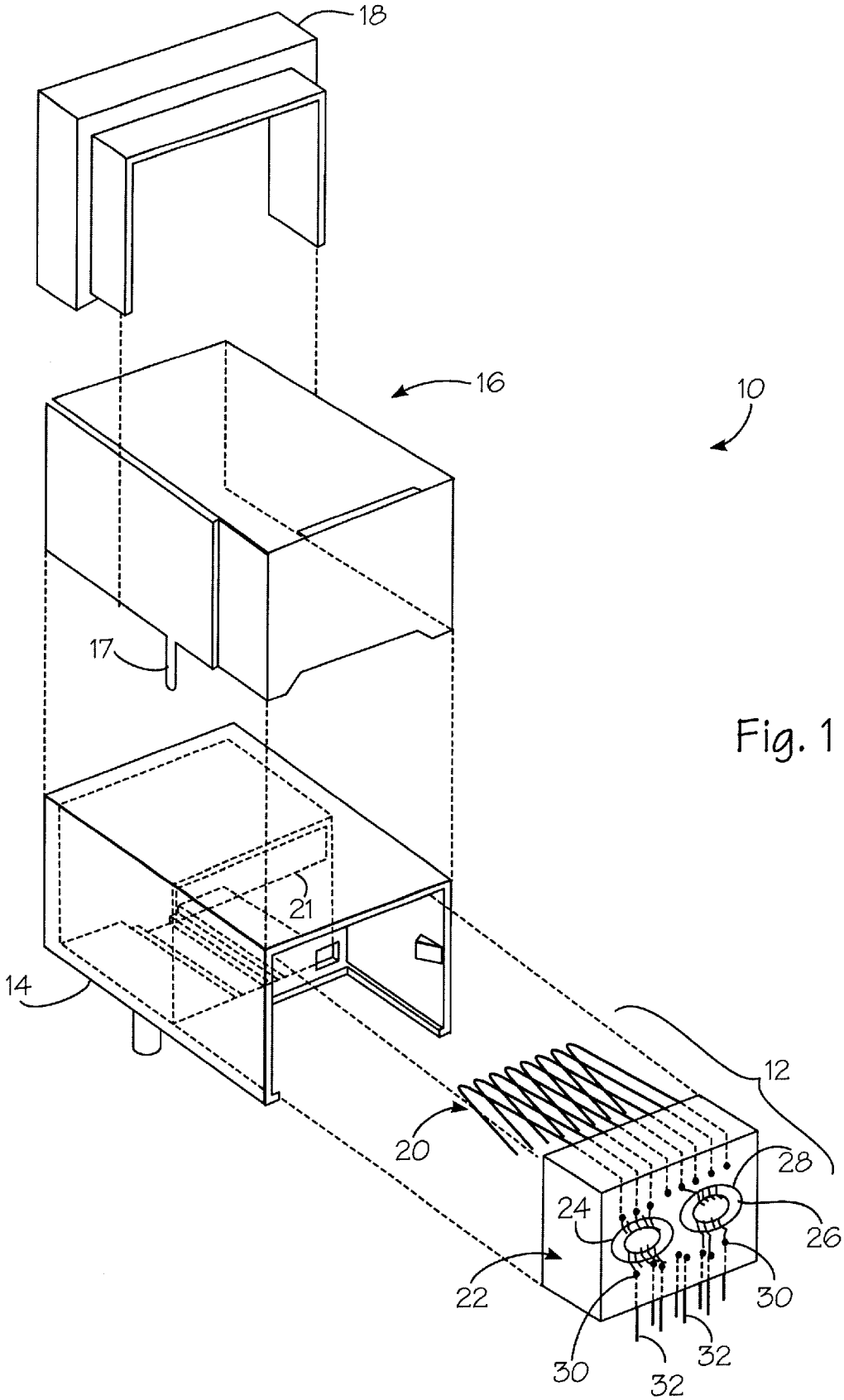
FIG. 1 is a perspective exploded assembly diagram of a single-port modular connector embodiment of the present invention.

FIG. 1 illustrates a single-port printed-circuit-board (PCB) mount modular connector embodiment of the present invention, referred to herein by the general reference numeral 10. The modular connector 10 comprises a snap-in insert assembly 12 that installs into a back end of a plastic housing 14 and solders down to a PCB. A metal Faraday shield 16 covers the top, sides and back of the assembled insert 12 and housing 14 and provides for electromagnetic-radiation (EMR) protection. A tab 17 is intended to be soldered to a groundplane of the PCB. A conductive flexible gasket 18 is used to collar the front end of the assembled housing 14 and shield 16 and provide RJ-45 jack grounding by bridging the small distance to an installed jack. For further details of this construction, see, U.S. Pat. No. 5,647,765, issued Jul. 15, 1997, to Haas, et al. Such Patent is incorporated herein by reference.

A group of spring connectors 20 passes through a hole 21 in a dividing wall within the housing 14 to ultimately connect with any RJ-45 plugged in from the front. The RJ-45 connection system is an industry standard and is ubiquitous in the data network industry. The group of spring connectors 20 provides for eight industry defined circuit connections that pass through a plastic insert body 22.

The typical RJ-45 connection to a data network is part of the physical interface layer and requires a modest amount of signal conditioning. It is critical to the present invention that such signal conditioning be implemented entirely within the volume of the insert body 22, and especially not off-connector on the PCB or in a "dog-house" back extension. The pin-out, pin placements, and overall form factor of the modular connector 10 are critical because it must the be form, fit, and function equivalent to preexisting PCB's that were designed for prior art modular connectors. The point of mounting the signal conditioning inside the insert body 22 is to save the PCB real estate that would otherwise be needed or not available, and to gain the EMR-related advantage of being inside the Faraday shield 16.

Such signal conditioning is represented in FIG. 1 with the example of a pair of torroid transformers 24 and 26, e.g., as produced and marketed by HALO Electronics (Redwood City, Calif.). For example, see, U.S. Pat. No. 5,656,985, issued Aug. 12, 1997, to Peter Lu, et al. Such Patent is incorporated herein by reference.

Other examples of signal conditioning can include ferrite slabs and cores, chip capacitors, and baluns. Such signal conditioning is connected by wires that are welded at points 28 to the group of spring connectors 20. The PCB side of the signal conditioning is attached by welding to points 30 on the tops of a set of eight PCB wiring posts 32. Such welding is critical to the present invention, as opposed to soldering, because the intended PCB mount will be subjected to soldering operations, e.g., vapor phase or wave solder, that could re-melt the signal conditioning connections and cause a conductivity unpredictability. Some consumers of such prior art modular connector combat this problem by using x-ray imaging to inspect the attachments after soldering operations. The shields are then installed after passing the x-ray inspection. The present invention is intended to make such x-ray inspections unnecessary, and thereby reduce manufacturing costs.

There are applications where soldering or using conductive epoxy could be used instead of welding the signal conditioning components to the PCB wiring posts.

Figure 2:
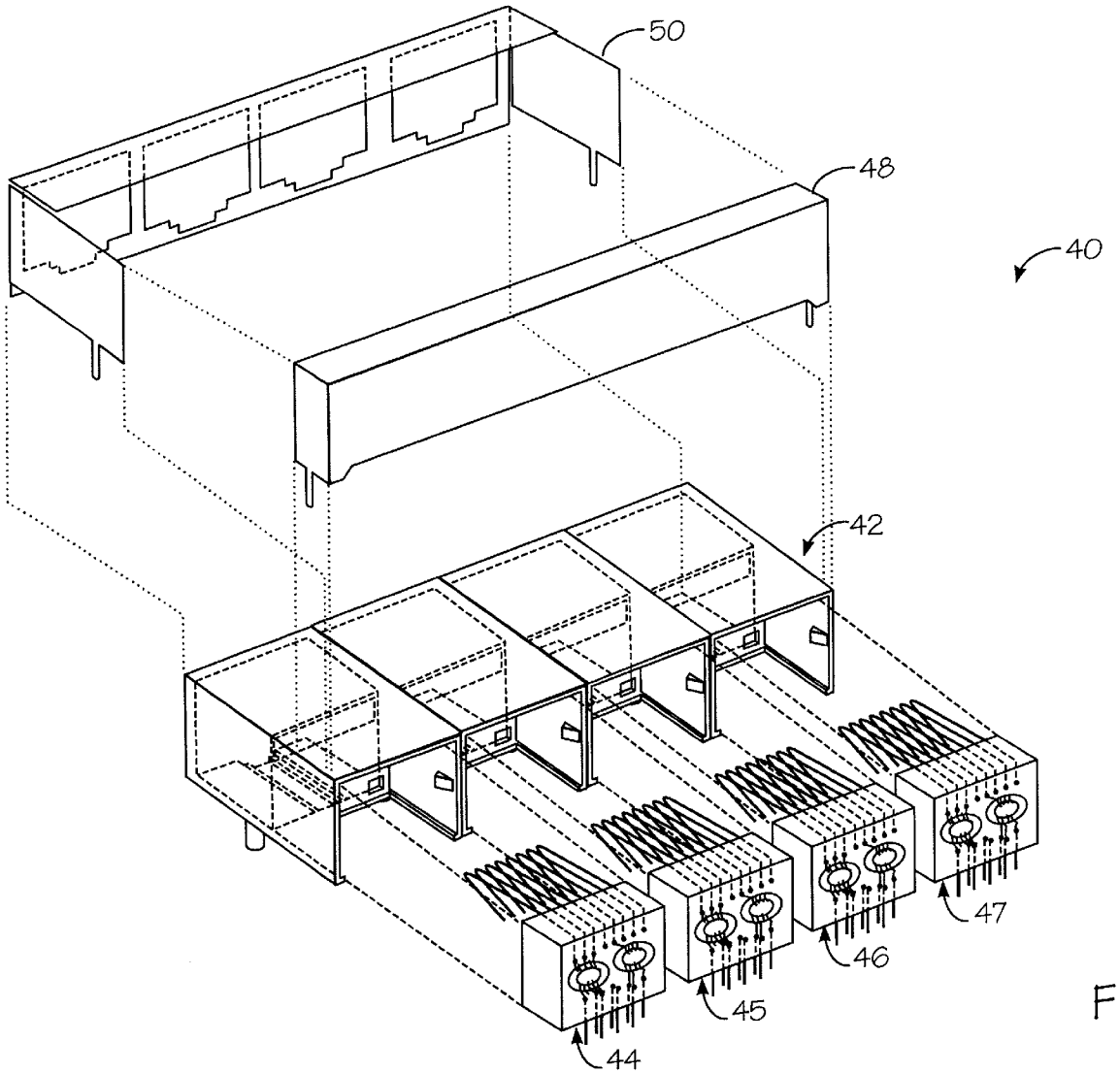
FIG. 2 is a perspective exploded assembly diagram of a four-port, single-row modular connector embodiment of the present invention.

FIG. 2 illustrates a four-port, single-row modular connector embodiment of the present invention, referred to herein by the general reference numeral 40. The modular connector 10 comprises a four-bay insulative housing 42 that accepts RJ-45 style jacks from its front and a gang of four molded inserts 44–47. Each such molded insert 44–47 is essentially the same as that described for the snap-in insert assembly 12 illustrated in FIG. 1. A two-piece Faraday shield comprises an aft part 48 that covers the rear of each of the four molded inserts 44–47, and a forward part 50 that covers the front, top, and sides of the four-bay insulative housing 42. Each bay of the four-bay insulative housing 42 is preferably the same so that a series of standardized molded inserts 44–47 may be produced that offer a selection of signal conditioning options for special applications.

Figure 3:
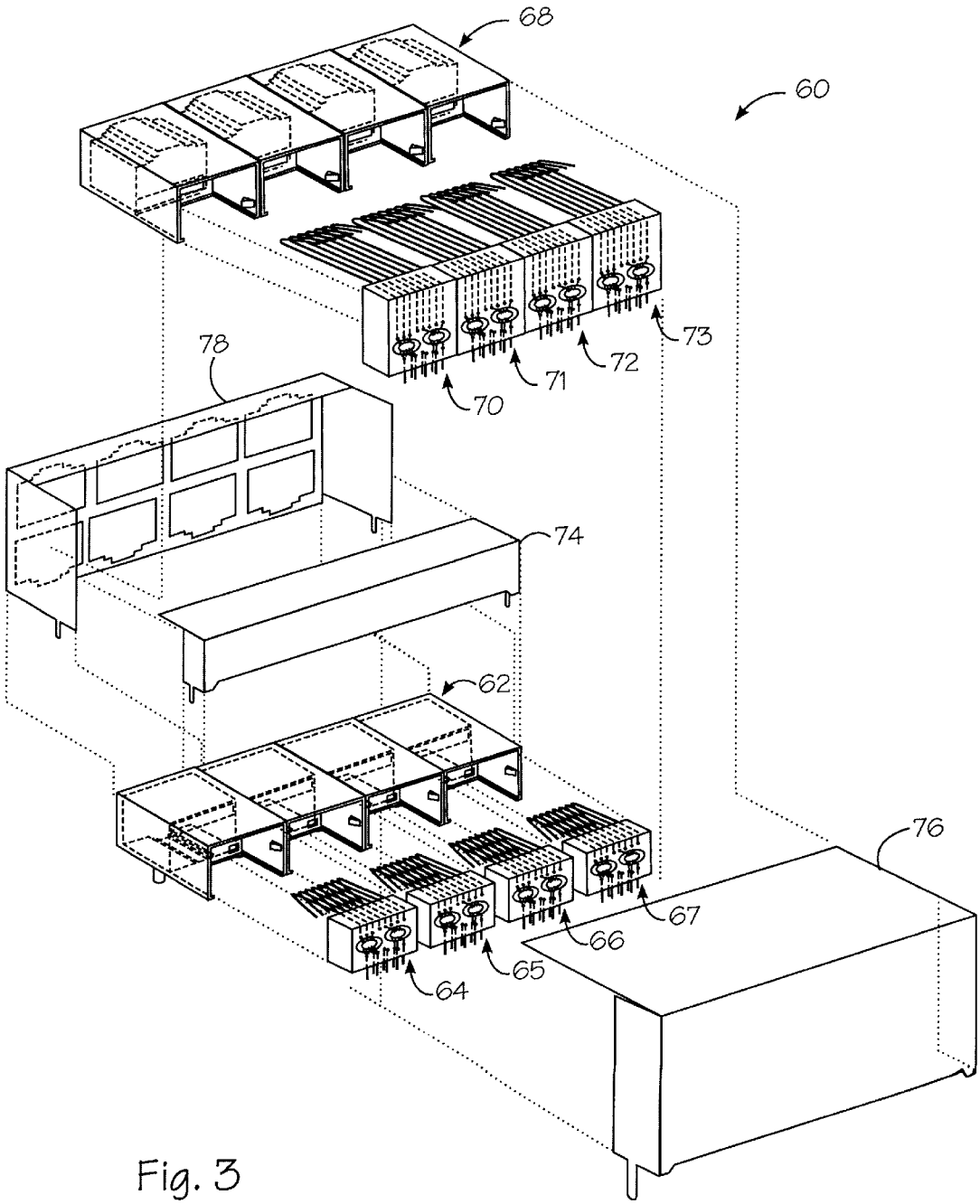
FIG. 3 is a perspective exploded assembly diagram of an eight-port two-row modular connector embodiment of the present invention.

FIG. 3 illustrates an eight-port, two-row modular connector embodiment of the present invention, referred to herein by the general reference numeral 60. The eight-port modular connector 60 comprises a lower row with a four-bay insulative housing 62 that accepts four RJ-45 style jacks from its front and a gang of four molded inserts 64–67. The four-bay insulative housing 62 and each molded insert 64–67 is essentially the same as that described for the four-port, single-row modular connector 40 illustrated in FIG. 2. In fact, the two are preferably identical so that the single-row modular connector 40 of FIG. 2 can be quickly and easily converted to the eight-port, two-row modular connector 60 of FIG. 3.

Such conversion would include an upper row four-bay insulative housing 68 that accepts four RJ-45 style jacks from its front and a gang of four molded inserts 70–73 that have forward extensions of their spring contacts so they can reach from behind far enough over the lower first row.

A three-piece Faraday shield comprises a lower middle part 74 that covers the rear of each of the four lower-row molded inserts 64–67, an aft part 76 covers the rear of each of the four upper-row molded inserts 70–73, and a forward part 78 that covers the front and sides of the four-bay insulative housings 62 and 68, and part of the top of housing 68. After assembly, the three Faraday shield pieces 74, 76, and 78 are electrically connected so that they constitute a continuous shield around the whole of the eight-port, two-row modular connector 60. Each molded insert 64–67 and 70–73 includes a signal conditioning circuit that provides a proper electrical coupling between a physical interface device (PHY) or encoder/decoder and an unshielded twisted pair (UTP) cable to a high speed computer network. In some applications, such signal conditioning and the circuitry used to effect the condition may have to vary in circuitry and component types from insert to insert. In such cases the present invention includes a snap-together construction that would allow a user to mix-and-match inserts by their signal conditioning types to their assigned positions in the bay rows.

Figure 4:
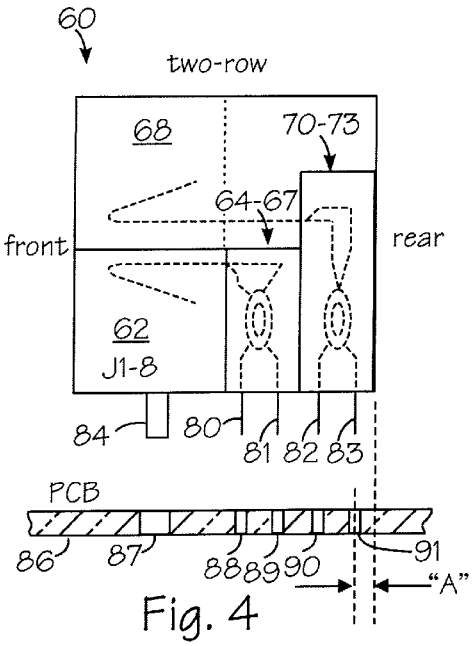
FIG. 4 is a side view of the eight-port two-row modular connector of FIG. 3 showing the critical maximum rear extension "A" required to maintain plug compatibility with preexisting connectors and showing the critical placement of the signal conditioning circuitry directly above the corresponding PCB mounting pins.

FIG. 4 is a side view of the eight-port two-row modular connector 60 of FIG. 3. A critical maximum rear extension "A" is required to maintain plug compatibility with preexisting connectors, dimension "A" is therefore limited to 0.100 inch. A first and second row of PCB mounting and connection pins 80 and 81 actually comprise four pins each in two rows for each molded insert 64–67. Similarly, a third and fourth row of PCB mounting and connection pins 82 and 83 actually comprise four pins each in two rows for each molded insert 70–73. Therefore, each molded insert 64–67 and 70–73 has eight pins that will be individually referred to herein as P1–P8. Pins P1, P3, P5, and P7 are positioned on 0.100 inch centers in a row set forward of the other row of pins by 0.100 inch. The second row of pins comprises P2, P4, P6, and P8, and they too are set on 0.100 inch centers but staggered 0.050 inch relative to pins P1, P3, P5, and P7. A post 84 helps secure and align the eight-port two-row modular connector 60 to a PCB motherboard 86. A set of plated-through holes 87–91 (in rows) respectively allow connections to the post 86 and connection pin rows 80–83.

FIG. 4 further shows the critical placement of the signal conditioning circuitry directly above the corresponding PCB mounting pins. Additional circuitry can be included in the free spaces above the molded inserts 64–67 and 70–73. Such space is especially accessible to the connector circuits of the upper row through the molded inserts 70–73. It may be preferable to position the signal conditioning circuitry in the upper end of the molded inserts 64–67 and 70–73 to improve insulation high-pot, cross talk, etc.

Figure 5:
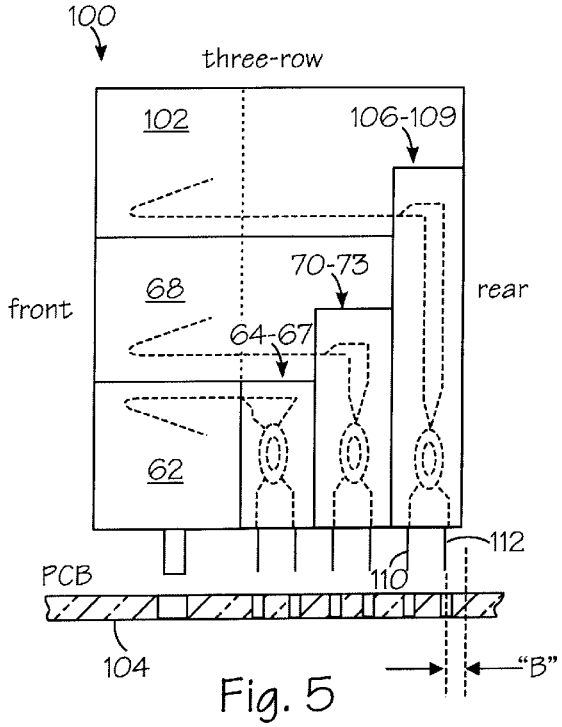
FIG. 5 is a side view of a three-row modular connector that started with the two-row modular connector of FIGS. 3 and 4.

FIG. 5 is a side view of a three-row modular connector 100 that can be fabricated by starting with the two-row modular connector 60 of FIGS. 3 and 4. FIG. 5 shows the critical maximum rear extension "B" required to maintain plug compatibility with preexisting connectors, dimension "B" is therefore limited to 0.100 inch. The limitation of dimension "A" in FIG. 4 has also allowed a third row 102 to be more easily added and without a large cost in additional real estate needed on a PCB 104. A third set of molded inserts 106–109 is added behind the second set 70–73. The signal conditioning circuitry for the third set of molded inserts 106–109 is also critically placed directly above its two rows of PCB mounting pins 110 and 112.

Figure 6:
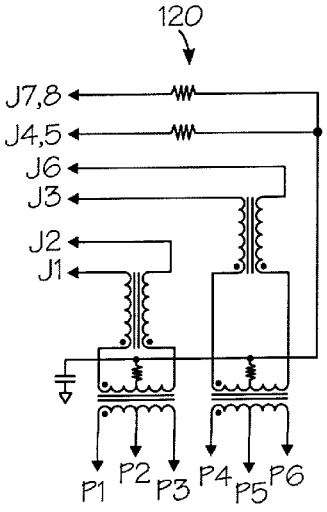
FIG. 6 is a schematic diagram of a DC blocking and filter-capacitor circuit, as may be required in the coupling of a PHY device to a cable medium in a 100BASE-T network application, and that may be implemented within the integrated signal conditioning part of any of the molded inserts shown in FIGS. 1–5.

FIG. 6 represents a DC blocking and filter-capacitor circuit 120 for coupling a PHY device through the PCB pins P1–P6 to a cable medium in a 100BASE-T network application through RJ-45 jack connections J1–J8. Such DC blocking and filter-capacitor circuit 120 may be implemented within the integrated signal conditioning part of any of the molded inserts 64–67, 70–73, and 106–109.

Figure 7:
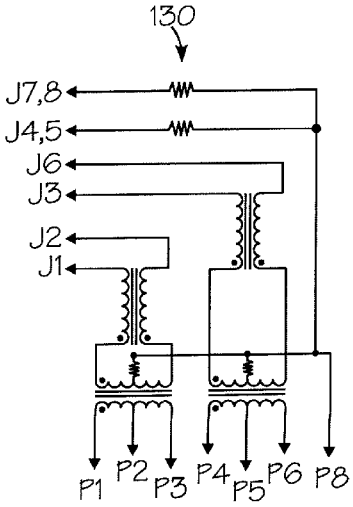
FIG. 7 is a schematic diagram of a DC blocking and series choke circuit, as may be required in the coupling of a PHY device to a cable medium in a 100BASE-T network application, and that may be implemented within the integrated signal conditioning part of any of the molded inserts shown in FIGS. 1–5.

FIG. 7 represents a DC blocking and series choke circuit 130 for coupling a PHY device through the PCB pins P1–P6 and 8 to a cable medium in a 100BASE-T network application through RJ-45 jack connections J1–J8. Such DC blocking and series choke circuit 130 may be implemented within the integrated signal conditioning part of any of the molded inserts 64–67, 70–73, and 106–109.

Figure 8:
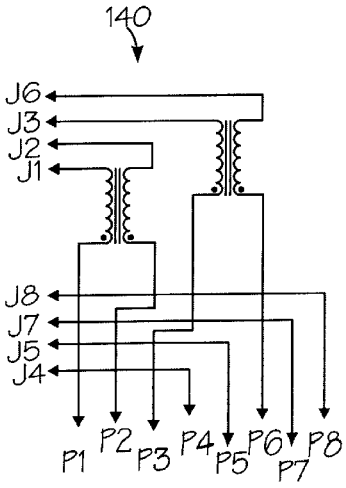
FIG. 8 is a schematic diagram of a common mode choke circuit, as may be required in the coupling of a PHY device to a cable medium in a 100BASE-T network application, and that may be implemented within the integrated signal conditioning part of any of the molded inserts shown in FIGS. 1–5.

FIG. 8 represents a common-mode choke circuit 140 for coupling, e.g., a PHY device, through the PCB pins P1–P8 to a cable medium in a 100BASE-T network application through RJ-45 jack connections J1–J8. Such common-mode choke circuit 140 may be implemented within the integrated signal conditioning part of any of the molded inserts 64–67, 70–73, and 106–109.

Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. An RJ-45 style modular connector, comprising:

a plastic rectangular housing with an open front end to receive a matching RJ-45 style modular jack, and an opposite open back end;

a contact spring assembly of a plurality of wires in separate circuits that pass forward through said open back end into the back of said open front end of the housing, wherein the contact spring assembly includes a plastic block that supports the plurality of wires by a right angle turn and is vertically oriented with respect to the plurality of wires, and wherein the plastic block inserts and locks into said open back end of the housing;

a set of mounting pins is disposed at a bottom edge of said plastic block for connection to a printed motherboard; and a signal conditioning part disposed in said plastic block for providing signal conditioning of signals passing from said set of mounting pins to said contact spring assembly ;

wherein, said signal conditioning part is fully disposed in said vertically oriented plastic block and directly over the set of mounting pins such that a standard form factor is not exceeded by a rear extension compartment that would otherwise be necessary, and that further provides for multilevel stacking.

2. The connector of claim 1, wherein the signal conditioning part includes a common choke to suppress noise interference associated with an Ethernet Local Area Network (LAN) operating on a LAN media cable connected with said contact spring assembly.

3. The connector of claim 1, wherein the signal conditioning part includes an isolation transformer to block direct current signal associated with an Ethernet LAN operating on a LAN media cable connected with said contact spring assembly.

4. The connector of claim 1, wherein the signal conditioning part includes an impedance matching transformer to couple Ethernet LAN signals between said set of mounting pins and a LAN media cable connected with said set of mounting pins.

5. The connector of claim 1, wherein the plastic block includes a snap-together construction such that mix-and-match signal conditioning parts are capable of being attached to the plastic block using the snap-together construction.

6. An RJ-45 style modular connector, comprising:

a plastic rectangular housing with a first plurality of open front end bays for each bay to receive a matching RJ-45 style modular jack, and an opposite second plurality of open back end bays;

and wherein each pair of open front and back end bays is associated with:

a contact spring assembly of a plurality of wires in separate circuits that pass forward through said open back end into the back of said open front end of the housing, wherein the contact spring assembly includes a plastic block that supports the plurality of wires by a right angle turn and is vertically oriented with respect to the plurality of wires and wherein the plastic block inserts and locks into said open back end of the housing;

a set of mounting pins in two fore-and-aft parallel rows on a uniform pin spacing is disposed at a bottom edge of said plastic block for connection to a printed motherboard; and a signal conditioning part disposed in said plastic block for providing signal conditioning of signals passing from said set of mounting pins to said contact spring assembly;

wherein, said signal conditioning part is fully disposed in said vertically oriented plastic block and directly over the set of mounting pins such that a standard form factor is not exceeded by a rear extension compartment that would otherwise be necessary, and that further provides for multilevel stacking.

7. The connector of claim 6, wherein:

the first plurality of open front end bays and second plurality of open back end bays are all disposed in a single horizontal row that abuts a printed circuit motherboard after mounting of said mounting pins, and neither the housing nor any of the plastic blocks extend to the rear substantially beyond a rear row of said mounting pins.

8. The connector of claim 6, wherein:

the first plurality of open front end bays and second plurality of open back end bays are evenly disposed in two horizontal rows, a lower row of which abuts a printed circuit motherboard after mounting of said mounting pins, and an upper row of which abut said first row and extend behind said first row to receive a corresponding set of extended-height spring assemblies; and wherein, neither the housing nor any of said plastic blocks in said extended-height spring assemblies extend to the rear substantially beyond a rear row of said mounting pins.

9. The connector of claim 6, wherein at least one of the signal conditioning parts include a common choke to suppress noise interference associated with an Ethernet LAN operating on a LAN media cable connected with a corresponding contact spring assembly.

10. The connector of claim 6, wherein at least one of the signal conditioning parts include an isolation transformer to block direct current signals associated with an Ethernet LAN operating on a LAN media cable connected with a corresponding contact spring assembly.

11. The connector of claim 6, wherein at least one of the signal conditioning parts include an impedance matching transformer to couple Ethernet LAN signals between said set of mounting pins connected with a LAN media cable.

12. The connector of claim 6, wherein the plastic block includes a snap-together construction such that mix-and-match signal conditioning parts are capable of being attached to the plastic block using the snap-together construction.

* * * * *